US007111954B1

(12) United States Patent
Lai

(10) Patent No.: US 7,111,954 B1
(45) Date of Patent: Sep. 26, 2006

(54) UMBRELLA WITH A LAMP

(76) Inventor: Jin-Sheng Lai, 4F., No. 77, Sec. 4, Nanking E. Rd., Taipei (TW)

( * ) Notice: Subject to any disclaimer, the term of this patent is extended or adjusted under 35 U.S.C. 154(b) by 0 days.

(21) Appl. No.: 11/224,932

(22) Filed: Sep. 14, 2005

(51) Int. Cl.
*A45B 3/02* (2006.01)
*F21V 33/00* (2006.01)

(52) U.S. Cl. ..... 362/102; 362/96

(58) Field of Classification Search ..... 362/102
See application file for complete search history.

(56) References Cited

U.S. PATENT DOCUMENTS 5,617,889 A * 4/1997 Wu ..... 135/22
6,439,249 B1 * 8/2002 Pan et al. ..... 135/16
6,612,713 B1 * 9/2003 Kuelbs ..... 362/102
2004/0100791 A1 * 5/2004 Bilotti et al. ..... 362/102
2004/0129304 A1 * 7/2004 Chen ..... 135/24
2004/0184261 A1 * 9/2004 Lin ..... 362/102

* cited by examiner

*Primary Examiner*—Renee Luebke
*Assistant Examiner*—Evan Dzierzynski
(74) *Attorney, Agent, or Firm*—Troxell Law Office, PLLC

(57) ABSTRACT

An umbrella with a lamp is primarily composed of a plurality of light sources embedded below ribs, with connection wires of the light sources passing into an upper nest and connected with an internal control circuit. The control circuit inside the upper nest is connected with a control circuit of a control part at a bottom of the upper stem, and the upper stem is flexibly connected with a lower stem which is provided with a power slot for inserting a transformer in order to provide the required power. Light can be automatically turned on/off at a pre-configured time, enabling a plurality of light sources to manifest a change of many kinds of light, thereby constituting an effect of lighting and decoration, without requiring manpower to turn on/off, by pre-configuring a turning on/off time with the control part.

6 Claims, 6 Drawing Sheets

UMBRELLA WITH A LAMP

BACKGROUND OF THE INVENTION (a) Field of the Invention

The present invention relates to an improved structure for an umbrella with a lamp and more particularly to a structure wherein a time of turning on/off the light can be pre-configured and which is specifically applied to a large sunshade.

(b) Description of the Prior Art

An umbrella is a very practical tool, which can be used to hide from raining in a rainy day and can also be used to shade sun in a sunny day. The large umbrella has been a current necessity for traveling, dining, and recreation, and has been changed from a conventional shading and rain-hiding tool into a tool having both a decoration and an art purposes.

Moreover, following the development of modern technology and the change in a viewpoint of appreciation of beauty, as a vision in night is unclear, light from an exterior lighting equipment is not easy to enable a person to clearly identify an outline of a sunshade, and is not able to enable the person to observe a facial expression of a person under the umbrella and to manifest a mood; in addition, as a large sunshade itself will also shade the light above a surrounding web, which will even dim the light under the web. Accordingly, in order to improve the shortcoming of lighting of the large sunshade, there is a kind of sunshade having a lighting lamp device which has been designed and sold in public. Although it can improve the lighting problem of the sunshade in the night time, this sunshade only consists of a lamp connected to ribs, wherein the lamp is directly under control of a power plug; when the plug is on, the lamp will be lighting, whereas when the plug is off, the lamp will be extinguished. In addition, the lamp cannot perform other changes. For example, when the quantity of sunshades is small, only a small amount of manpower will be required to accomplish the operation of turning on the power to all the sunshades; whereas when the quantity of sunshades is large, a large amount of manpower will be consumed to plug or to unplug one by one after using, which is not perfect.

Accordingly, how to improve the existing shortcoming of the aforementioned umbrella with a lamp which has been used in public, and to provide an improved structure wherein a time of turning on/off the power can be pre-configured, for providing a safe use to general consumers, has been a motivation of the present invention.

SUMMARY OF THE INVENTION

The primary object of the present invention is to provide an improved structure of an umbrella with lamp, wherein a time of turning on/off the power can be pre-configured to electronically perform an automatic control.

Another object of the present invention is to provide an improved structure of an umbrella with lamp which does not require a large amount of manpower for turning on/off the power, thereby saving the manpower.

Accordingly, the present invention includes primarily a plurality of light sources embedded below the ribs, with connection wires of the light sources passing into an upper nest and connected to an internal control circuit. Each middle section of the ribs is connected to a lower nest through a short rib, and a hollow upper stem passes through the lower nest to be connected with the upper nest, such that the lower nest can glide on the upper stem. The control circuit inside the upper nest is connected with a control circuit at a bottom of the upper stem, whereas the upper stem is flexibly connected with a lower stem having a power slot for inserting a transformer in order to provide the required power. By a means of a control part to pre-configure a turning on/off time, the light can be automatically turned on/off when the configured time is reached, which will enable a plurality of light sources to manifest a change of many kinds of light, thereby constituting an effect of lighting and decoration, without requiring the manpower to turn on/off the power.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
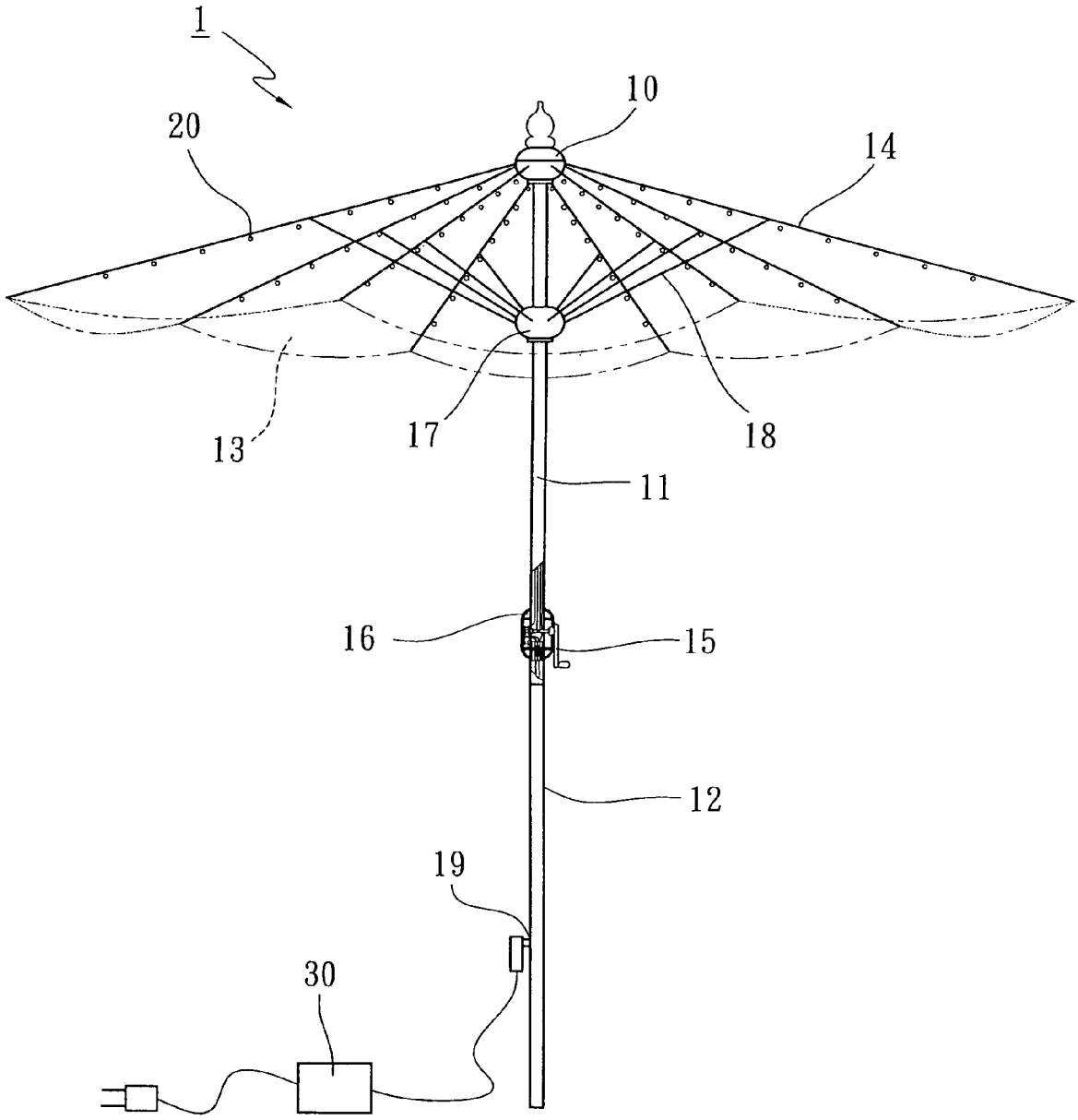
FIG. 1 shows a schematic view of an implementation of the present invention

Referring to FIG. 1, a large sunshade 1 of the present invention consists of a plurality of ribs 14 connected to an upper nest 10, and a waterproof web 13 which is connected to an exterior of the ribs 14. Each middle section of the ribs 14 is connected to a lower nest 17 through a short rib 18, and an upper stem 11 passes through the lower nest 17 to be combined with the upper nest 10. A control part 16 and a rotating handle 15 are located at a bottom of the upper stem 11, such that the lower nest 17 can glide on the upper stem 11. A power slot 19 is located at a proper position on a bottom of a lower stem 12 for inserting an AC transformer 30.

Figure 2:
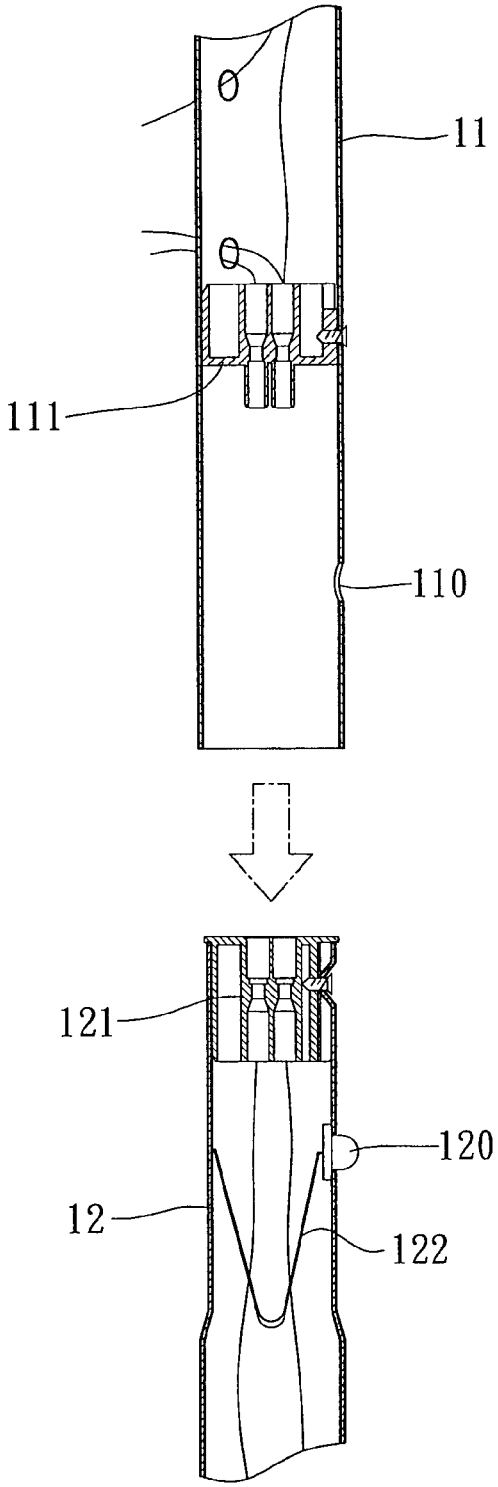
FIG. 2 shows a schematic view of disassembling an upper stem and a lower stem of the present invention.
Figure 3:
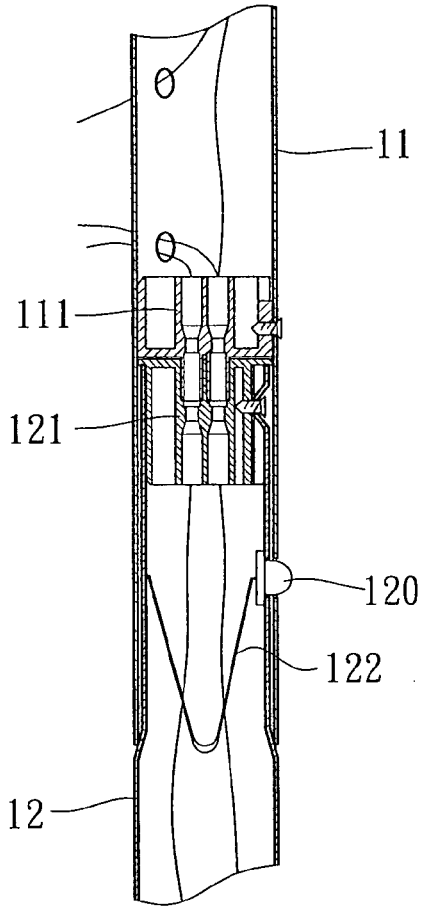
FIG. 3 shows a schematic view of assembling an upper stem and a lower stem of the present invention.

Referring to FIG. 2, a positioning hole 110 is located at a bottom of the aforementioned upper stem 11, and a power connector 111 is located in an interior side of the upper stem 11. On the other hand, a positioning part 120 is located at a corresponding position at a top of the lower stem 12, and an elastic member 122 is connected at a rear side of the positioning part 120. A corresponding power connector 121 matching with the power connector 111 is also located at a top end of the lower stem 12. Accordingly, when the upper stem 11 is combined with the lower stem 12, the positioning hole 110 is positioned by the positioning part 120, and the power connectors 111, 121 are connected correspondingly. In order to disassemble the upper stem 11 and the lower stem 12, the interior elastic member 122 can be elastically compressed only by pressing down the positioning part 120, to successfully remove the two stems.

Figure 4:
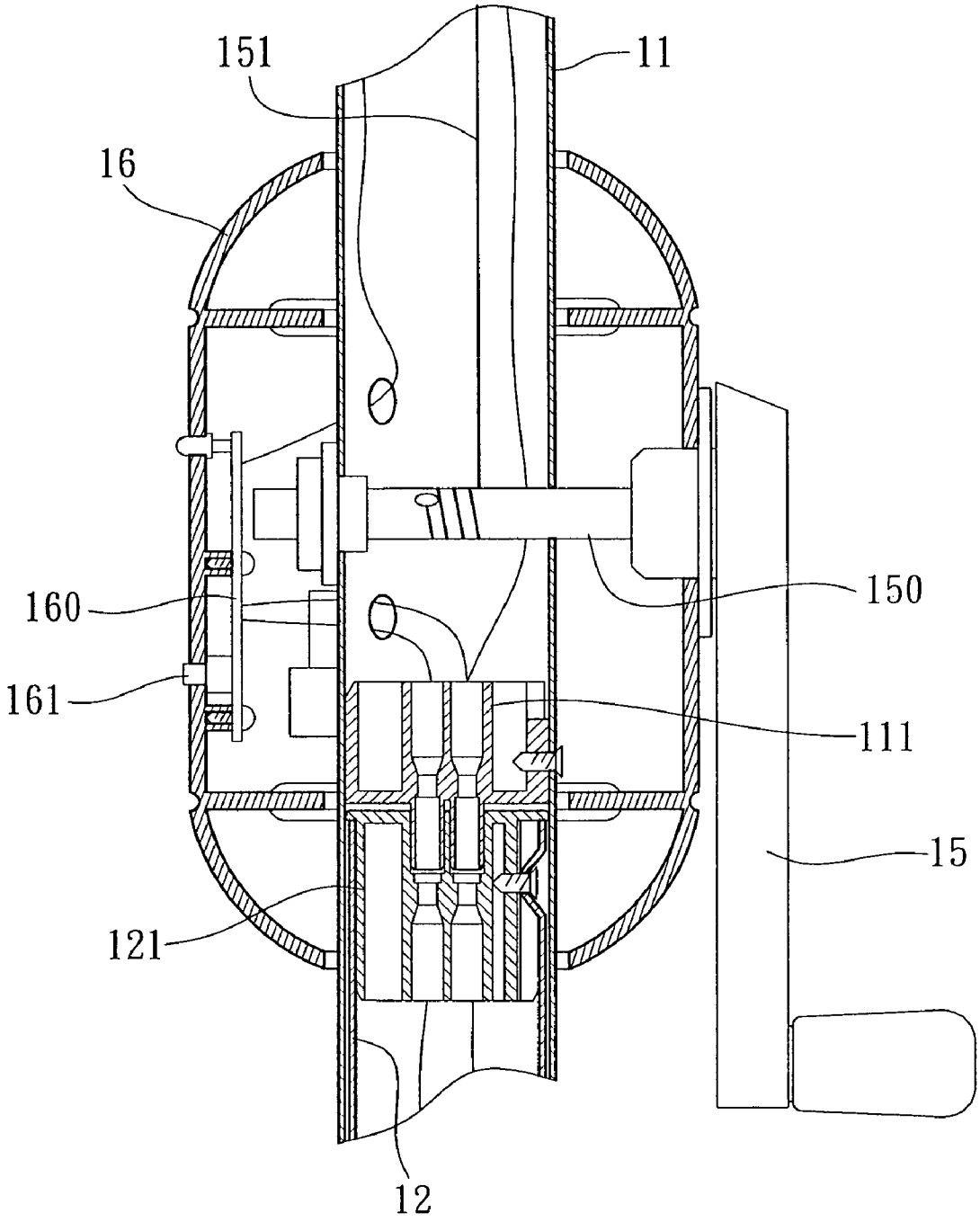
FIG. 4 shows a cutaway view of a control part of the present invention.
Figure 7:
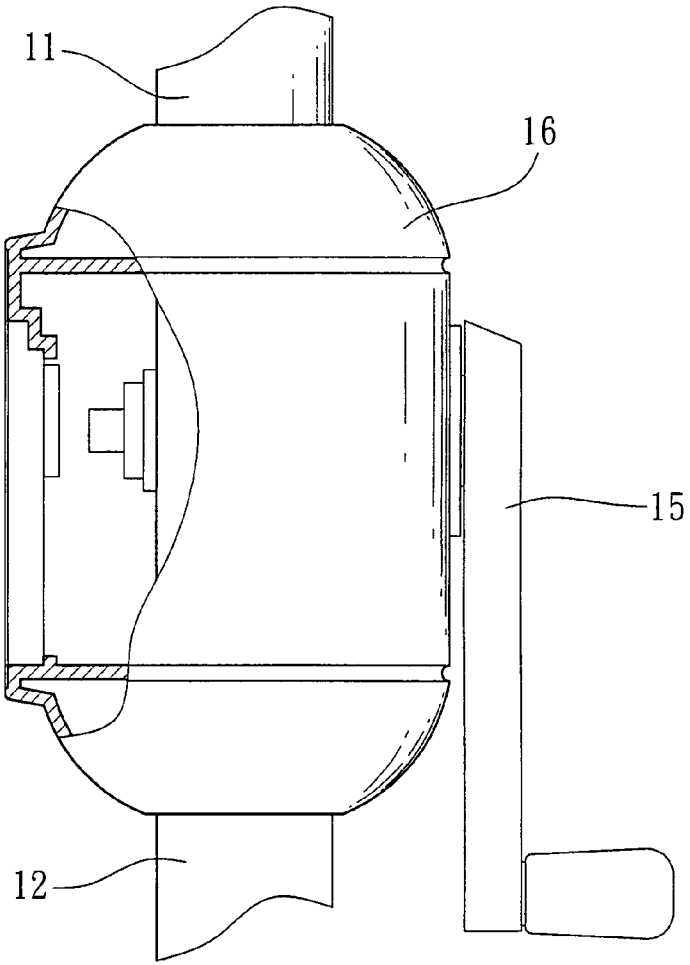
FIG. 7 shows a side view of a control switch of the present invention.
Figure 6:
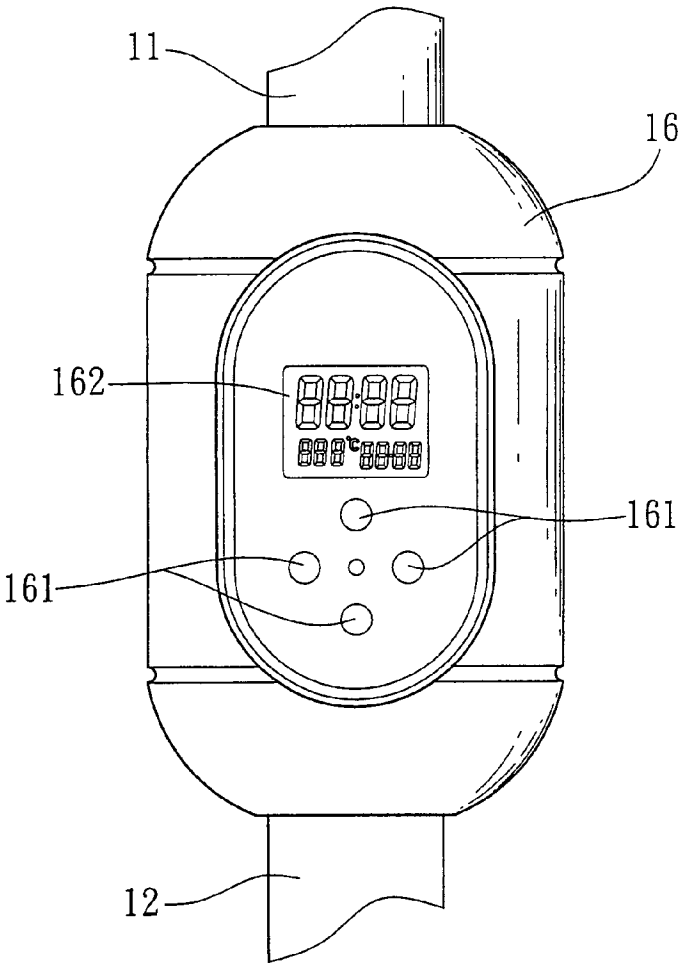
FIG. 6 shows a front view of a control switch of the present invention.

Referring to FIGS. 4, 6, and 7, the control part 16 is located on the upper stem 11, at a position close to its bottom. An liquid crystal display (LCD) screen 162 (as shown in FIG. 6), and a plurality of function control keys 161 are located at an exterior edge of the control part 16. The rotating handle 15 (as shown in FIG. 7) which can control an opening or collapsing of the web is located at a corresponding back side of the control part 16. The LCD screen 162 and the plurality of control keys 161 are linearly connected with an internal control circuit board 160 which contains a timing circuit, a ringing circuit, and a temperature sensing circuit. The control circuit board 160 is also linearly connected with the power connector 111, in order to provide the required power for operating the control circuit board 160. A transversal shaft 150, which is located at a top end of the rotating handle 15, passes through the upper stem 11 and is connected to a lower end of a rope 151. An upper end of the rope 151 reeves on a roller (not shown in the drawings) located at a top end of the upper stem 11, and is connected with the lower stem 17, thereby enabling the lower nest 17 to be controlled by a rotation of the rotating handle 15 such that the lower nest 17 can be lifted up or lowered down through the rope 151.

Figure 5:
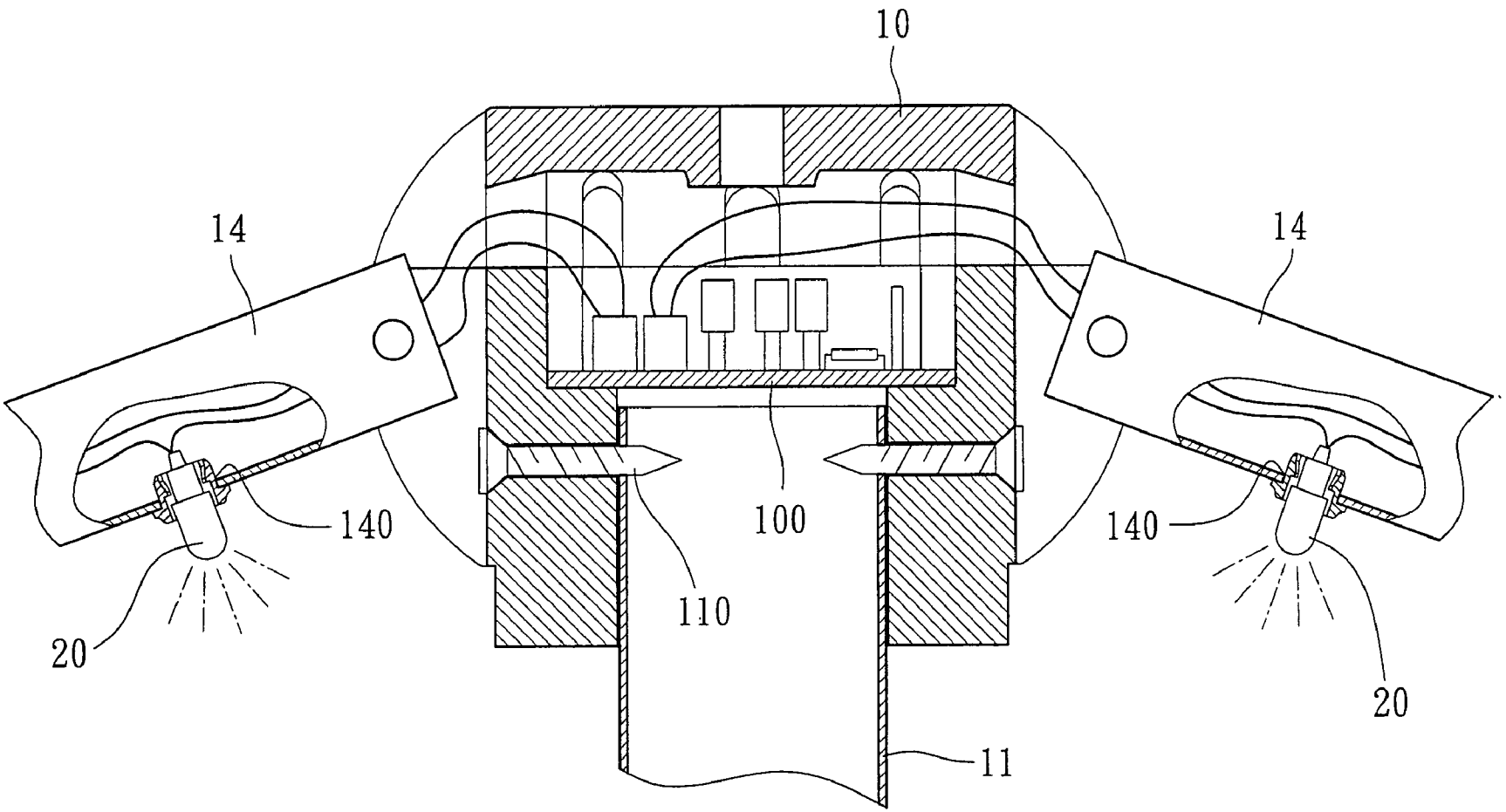
FIG. 5 shows a cutaway view of an upper nest of the present invention.

Referring to FIG. 5, a top of the upper stem 11 is connected with the upper nest 10 using screws 110, and a periphery of the upper nest 10 is connected with the plurality of ribs 14. A control circuit board 100, which is located inside the upper nest 10, is linearly connected with light sources 20, which are light emitting diodes (LED), located inside the plurality of ribs 14. A plurality of latching slots 140 is located on the ribs 14 for embedding the LED of the light sources 20, thereby accomplishing an assembling of the light sources of the present invention.

Figure 8:
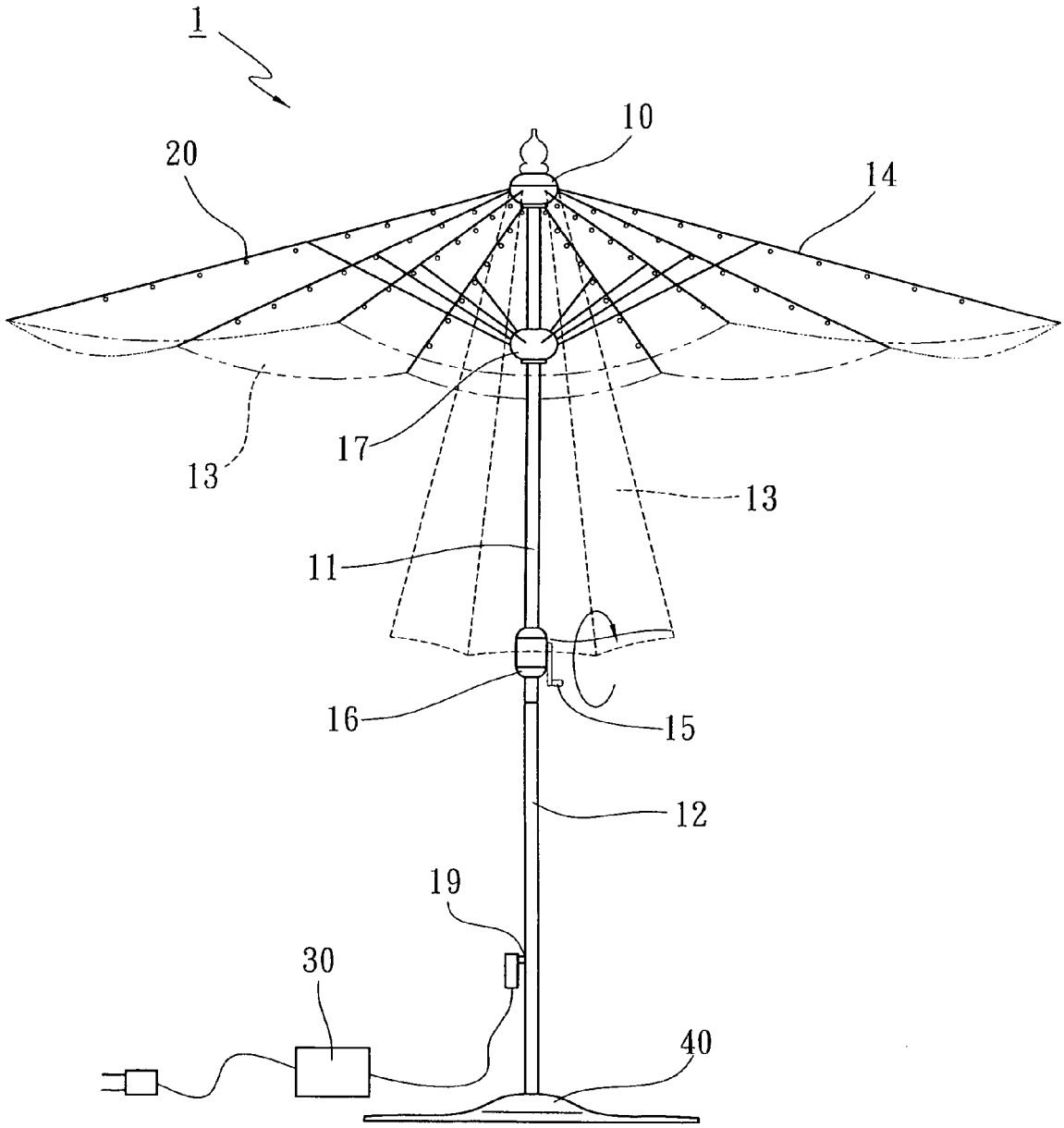
FIG. 8 shows a schematic view of operation of an implementation of the present invention.

Referring to FIG. 8, it shows an implementation wherein a heavy seat 40 is added, so as to insert the lower stem 12 on the seat 40, thereby enabling the large sunshade 1 of the present invention to stand up firmly without being blown down by a strong wind. In using, the transformer 30 is inserted with an AC power, and the lower nest 17 is controlled to a proper height by rotating the rotating handle 15, which in turn controls an opening of the web 13. Moreover, a user can control the circuit board 160 through the exterior control keys 161 of the control part 16, to adjust time of the internal timing circuit, and to pre-configure the pre-determined turning on/off time by estimating a sunset time according to a change of season. For example, the configured turning on/off time can be set to 18:00/23:00 PM, and music of ringing and a function of blinking of the light sources can be chosen. When the time reaches 18:00 PM, the control part starts to play the music, and the light sources 20 will be lighting completely, be blinking symmetrically, or be blinking completely according to the original configuration, which can also increase a life flavor through a pressing to the control keys 161 on the control part 16. On the other hand, when the time reaches 23:00 PM, the control part 16 will automatically turn off the power to the light sources 20, without requiring manpower to unplug one by one, thereby achieving an operation style with a saving in time and effort.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. An umbrella with a lamp comprising:

a) an upper stem having an upper control circuit board;

b) a lower stem connected at an upper end thereof to a lower end of the upper stem and having a power slot connected to a transformer;

c) an upper nest located on an upper end of the upper stem;

d) a lower nest slidably located on the upper stem;

e) a plurality of ribs movable between open and closed positions, each of the plurality of ribs being pivotally connected at a first end to the upper nest;

f) a plurality of light sources electrically connected to the upper control circuit board and located below each of the plurality of ribs when the plurality of ribs are in the open position;

g) a plurality of short ribs, each of the plurality of short ribs is pivotally connected at a first end thereof to the lower nest, one of the plurality of short ribs is pivotally connected at a second end thereof to a middle portion of each of the plurality of ribs; and h) a control part located on the lower end of the upper stem and having:

i) a handle connected to the lower nest by a rope and selectively moving the plurality of ribs movable between the open and closed positions;

ii) a lower control circuit board electrically connected to the upper control circuit board and the power slot selectively turning on and off the plurality of light sources at predetermined times;

iii) a liquid crystal display screen; and iv) a plurality of control keys electrically connected to the lower control circuit board and the liquid crystal display screen, wherein the lower stem has a lower power connector located on an interior of the upper end thereof and electrically connected to the power slot, the upper stem has an upper power connector located on an interior of the lower end thereof and electrically connected to the lower control circuit board, the lower power connector is selectively connected to the upper power connector.

2. The umbrella according to claim 1, further comprising a web located above each of the plurality of ribs when the plurality of ribs are in the open position.

3. The umbrella according to claim 1, wherein each of the plurality of light sources is a light emitting diode.

4. The umbrella according to claim 1, wherein the lower stem has a positioning part located on the upper end thereof, the upper stem has a positioning hole located on the lower end thereof, the positioning part is selectively inserted into the positioning hole.

5. The umbrella according to claim 1, further comprising a seat connected to a lower end of the lower stem.

6. The umbrella according to claim 1, wherein each of the plurality of ribs has a plurality of latching slots, one of the plurality of light sources is located in each of the plurality of latching slots.

* * * * *